US009253583B2

(12) United States Patent
Blamey et al.

(10) Patent No.: US 9,253,583 B2
(45) Date of Patent: Feb. 2, 2016

(54) AUTOMATED FITTING OF HEARING DEVICES

(75) Inventors: Peter John Blamey, South Yarra (AU); Henry Carter Smith, Bristol, PA (US); David Wright, Yardley, PA (US)

(73) Assignee: Blamey & Saunders Hearing Pty LTD., Melbourne (AU)

( * ) Notice: Subject to any disclaimer, the term of this patent is extended or adjusted under 35 U.S.C. 154(b) by 653 days.

(21) Appl. No.: 13/201,033

(22) PCT Filed: Feb. 16, 2010

(86) PCT No.: PCT/AU2010/000161
§ 371 (c)(1),
(2), (4) Date: Nov. 15, 2011

(87) PCT Pub. No.: WO2010/091480
PCT Pub. Date: Aug. 19, 2010

(65) Prior Publication Data

US 2012/0051569 A1 Mar. 1, 2012

(30) Foreign Application Priority Data

Feb. 16, 2009 (AU) ..... 2009900633

(51) Int. Cl.
*H04R 25/00* (2006.01)

(52) U.S. Cl.
CPC ..... *H04R 25/70* (2013.01)

(58) Field of Classification Search
CPC ..... H04R 25/70
See application file for complete search history.

(56) References Cited

U.S. PATENT DOCUMENTS 5,197,332 A 3/1993 Shennib
6,118,877 A 9/2000 Lindemann et al.

(Continued)

FOREIGN PATENT DOCUMENTS

WO 2007/110073 10/2007

OTHER PUBLICATIONS

HeLPS Sensimetrics User Guide, Dec. 18, 2007, Retrieved from http://web.archive.org/web/20070624105212/www.sens.com/helps/pdf/HeLPS%User%Guide.pdf on Apr. 20, 2010, 38 pgs.
International Preliminary Report on Patentability for International Application No. PCT/AU2010/000161, International Filing Date Feb. 16, 2010, Search Completed Aug. 16, 2011, 13 pgs.

(Continued)

*Primary Examiner* — Duc Nguyen
*Assistant Examiner* — Taunya McCarty
(74) *Attorney, Agent, or Firm* — KPPB LLP

(57) ABSTRACT

Fitting a sound processing device for an individual is automated using a computer. Fitting and customization is carried out using natural sounds without specialized audiometric equipment or audiological expertise. Software for this purpose is downloaded from an internet portal. The computer plays back acoustic signals, and obtains user input reflecting the user's perceptions of the acoustic signals, from which a hearing map is derived, representing the user's hearing. An algorithm updates the device fitting based on the hearing map. Also provided is pre-sale virtual device fitting, whereby a virtual signal processing path is established in the computer, reflecting a signal processing function of a sound processing device of interest to the user. An algorithm updates parameters of the virtual processing path, based on the hearing map. Audio signals passed through the virtual processing path are played back to the user, giving the user an acoustic indication of future device performance.

11 Claims, 5 Drawing Sheets

(56) References Cited

U.S. PATENT DOCUMENTS

| | | | | |
|---|---|---|---|---|
| 2005/0033193 | A1* | 2/2005 | Wasden et al. | 600/559 |
| 2005/0249368 | A1 | 11/2005 | Menzl et al. | |
| 2006/0178711 | A1 | 8/2006 | Patrick et al. | |
| 2010/0272297 | A1* | 10/2010 | Boretzki | 381/312 |

OTHER PUBLICATIONS

International Search Report and Written Opinion for International Application No. PCT/AU2010/000161, International Filing Date Feb. 16, 2010, Search Completed Apr. 29, 2010, Mailed May 4, 2010, 18 pgs.

* cited by examiner

Figure 5
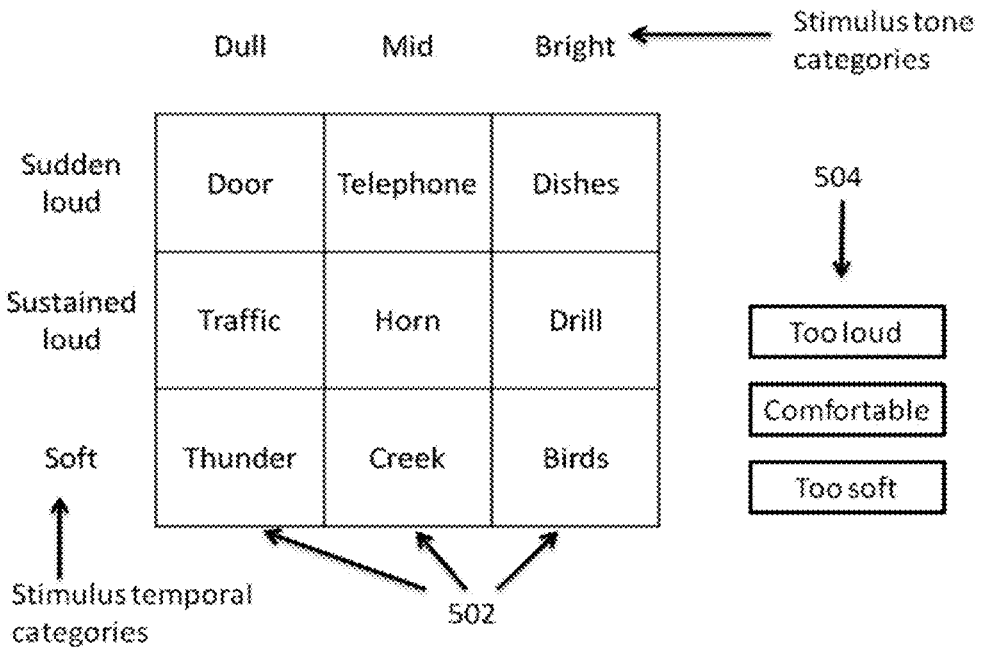
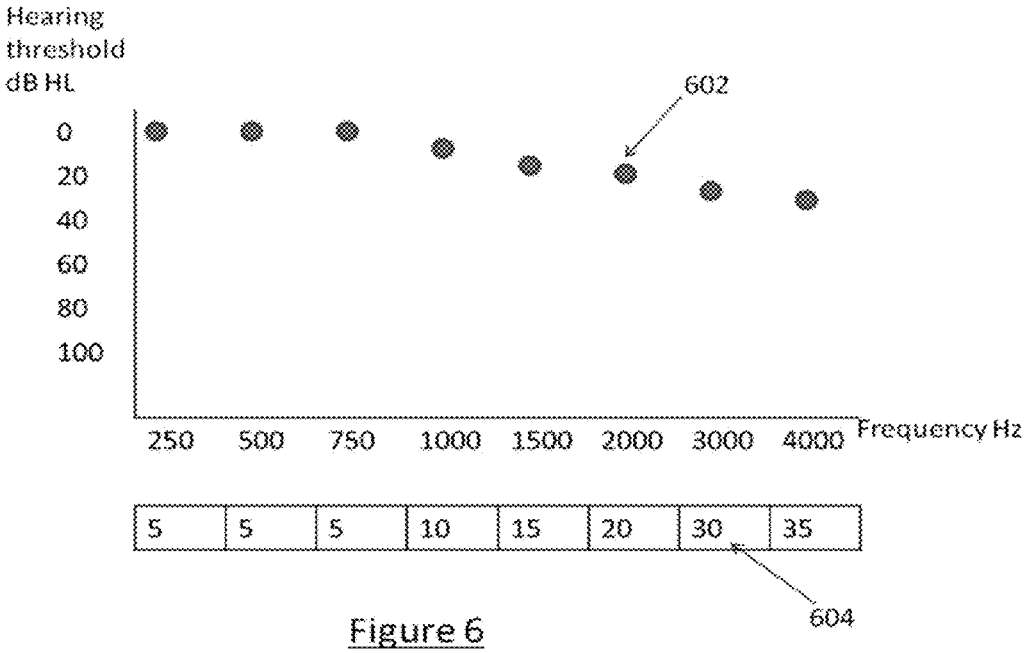
Figure 6

| | Left ear | Right ear |
|---|---|---|
| 1) How many times per day does your hearing aid whistle (feedback) while wearing it? | Never<br>1-2 times<br>3-6 times<br>6 or more times | Never<br>1-2 times<br>3-6 times<br>6 or more times |
| 2) The loudness of your own voice sounds | Too loud<br>Loud but OK<br>Comfortable<br>Soft but OK<br>Too soft | Too loud<br>Loud but OK<br>Comfortable<br>Soft but OK<br>Too soft |
| ... | ... | ... |

AUTOMATED FITTING OF HEARING DEVICES

TECHNICAL FIELD

The present invention relates to the provision of audiological services and products to consumers, and in particular relates to automation of related tasks such as the measurement of characteristics of an individual consumer's hearing, the storage and analysis of hearing information, the customisation of products that enhance the hearing of sound by the consumer, and the objective validation that enhanced hearing has been achieved.

BACKGROUND OF THE INVENTION

Sound processing devices, including hearing aids, assistive listening devices (ALDs) (defined by the Global Medical Device Nomenclature Agency (GMDNS) as being an amplifying device, other than a hearing aid, for use by a hard of hearing person), and consumer audio devices including headsets, headphones, mobile phone handsets, and MP3 players are being used more frequently in noisy environments by people with normal or near-normal hearing as well as people who are hard of hearing or have impaired hearing. Using such sound processing devices, hearing can be enhanced by adjusting the loudness, frequency-shaping, and dynamic properties of the sounds produced by the devices to suit the needs and preferences of the individual listener. Some of these types of adjustments are commonly available in consumer audio devices by means of analogue volume controls and tone controls.

However, the majority of these sound processing devices now use complex digital signal processing which enables a wide variety of adjustments and customisations of device operation, to suit the individual needs and preferences of the user. For example, digital signal processing often includes many or all of: feedback cancellation, dynamic range optimisation, compression, compression "knee points", maximum output control, adaptive directional microphones, side tone, echo suppression, and the like. Each such process is often controlled by parameters which can be adjusted to customise the device operation to the user. Such device optimisation is referred to as "fitting" the device to the user. At the same time, devices are becoming smaller and do not have the physical space available for the complex controls that would be necessary to make such a wide variety of adjustments. Consequently, sound processing devices increasingly provide for such adjustments to be made by use of an applications program running on a computer. Once a customised solution is settled upon, the necessary settings are downloaded from the computer to the device by a data connection, to suitably control subsequent operation of the device when in standalone use.

In the case of hearing aids, fitting requires audiological services which are typically provided by audiologists and/or audiometrists in a clinical setting. Initially the user's audiogram must be obtained so that device customisation can be optimised to that user's actual hearing loss. Determining a user's audiogram is a specialist task carried out by an audiologist in a clinical setting. The audiologists' fitting software for modern hearing aids may manipulate hundreds of parameters that control the operation of the hearing aid, with optimised parameter values downloaded to the device after fitting is complete. To suitably optimise operation of the device by controlling the numerous available parameters typically requires a skilled audiologist, audiometrist, or hearing aid fitter. The cost of such services, whether borne by the user or a public health system, significantly adds to the expense of hearing aids. Moreover, the limited supply of suitably skilled audiologists presents hearing aid users with limited or delayed access to fitting or re-fitting services. For persons in rural areas or in poorer countries, or persons having only mild hearing impairments, these difficulties can prevent use of such services for proper device fitting and/or can prevent device use entirely.

The processing parameters of sound processing devices other than hearing aids are typically configured by the manufacturer prior to sale of the device, in a manner which tailors the device to the needs of the average consumer, rather than customising it for an individual. For some devices, for example some ALDs, a number of preconfigured customisations may be downloaded into the device prior to sale, with the user given a limited choice between the small number of preconfigured customisations.

The sound processing device fitting methods described above suffer from the disadvantage that either a skilled fitter is required to operate the fitting software (as in the case of a hearing aid), or a single 'average' fitting or small number of preconfigured customizations is too limited to be well suited to each individual.

Any discussion of documents, acts, materials, devices, articles or the like included in the present specification is for the purpose of providing a context for the present invention, and is not to be taken as an admission that any such matters form part of the prior art base or were before the priority date of each claim of this application common general knowledge in the field relevant to the present invention.

In this document the term "comprise", and derivatives thereof including "comprises", "comprised" and "comprising", are to be understood to convey inclusion of one or more stated elements, integers or steps, but not the exclusion of any other element, integer or step.

SUMMARY OF THE INVENTION

According to a first aspect the present invention provides a method of fitting a sound processing device for an individual, the method executed by a computing device and comprising:

- playing back acoustic signals to the user,
- obtaining user input related to the user's perceptions of the acoustic signals;
- deriving from said user input a hearing map representing the user's hearing; and
- updating a fitting of the sound processing device based on said hearing map.

According to a second aspect the present invention provides a device for fitting a sound processing device for an individual, the device comprising:

- an audio output;
- a user interface to accept user input;
- a processor configured to play back acoustic signals to the user via the audio output and to obtain via the user interface user input related to the user's perceptions of the acoustic signals, the processor further configured to derive from said user input a hearing map representing the user's hearing, and the processor further configured to update a fitting of the sound processing device based on said hearing map.

According to a third aspect the present invention provides a computer program product comprising a computer-readable storage medium storing computer program code means to make a computer execute a procedure for fitting a sound processing device for an individual, the computer program product comprising:

computer program code means for causing play back of acoustic signals to the user, computer program code means for obtaining user input related to the user's perceptions of the acoustic signals;

computer program code means for deriving from said user input a hearing map representing the user's hearing; and computer program code means for updating a fitting of the sound processing device based on said hearing map.

Embodiments of the first to third aspects of the invention thus provide sound processing device users with a more convenient and immediate way to obtain a hearing map representing their hearing, without the need to visit an audiologist. Preferred embodiments of the first to third aspects of the invention further provide for a microphone to monitor and control the sound pressure level of the sounds presented to the consumer. The microphone is preferably a calibrated microphone.

In some embodiments of the first to third aspects of the invention, the acoustic signals are synthesised or recorded spoken words, and the user interface enables the user to enter the word or words which they hear. The processor then preferably determines an accuracy of the user input relative to the words actually played back. In such embodiments the hearing map may be derived from the user input by way of a reverse Articulation Index-type calculation, which estimates the percentage of information transmitted to the user within specific frequency bands in order to estimate hearing map parameters such as the effective sensation level of the acoustic signals in each frequency band.

Additionally or alternatively, in embodiments of the first to third aspects of the invention the hearing map may be derived in response to user input giving the user's answers to a hearing questionnaire. The questionnaire is preferably presented to the user by the fitting software of the present invention. The questionnaire preferably involves the fitting software playing back an acoustic signal, and prompting the user to select from a plurality of presented choices a category which best describes how the played back acoustic signal sounded to them. The played back acoustic signals of the questionnaire may in some preferred embodiments be configured to test a range of characteristics of the user's hearing and for example may include a selection of sounds selected to be dull, moderate or bright, and selected to be sudden, sustained or soft.

Additionally or alternatively, the fitting software may present queries to the user regarding their everyday experiences using the sound processing device. For example the queries may ask the user to recall: how often the device suffers from oscillatory feedback "whistle"; how they perceive the quality and/or loudness of their own voice and breathing; whether device "beeps" are suitably audible; how they perceive the quality and loudness of speech on TV and radio; how they perceive the loudness and quality of interpersonal speech, whether in the presence or absence of background noise; how they perceive the loudness and quality of music; and preferred genres of music.

The user input preferably provides the user's responses on certain aspects of the user's hearing characteristics, needs, and preferences. These data may include hearing thresholds, comfort levels, and discomfort thresholds; sound quality ratings for music and other sounds; and speech intelligibility scores for controlled presentation of speech stimuli. The user input is preferably recorded by the fitting software.

The hearing map may be an audiogram. Alternatively the hearing map may be other or additional representations of the user's hearing, for example the user's hearing thresholds, comfort levels and discomfort thresholds or the desired output levels for speech sounds may be established or estimated in each of a small number of frequency bands. The hearing map preferably comprises a plurality of variable values held in a memory of the computing device, each value determined from the user input and reflecting a particular characteristic of the user's hearing, such as a band-specific hearing threshold, comfort level, discomfort threshold or desired output level for speech.

In embodiments of the first to third aspects of the invention, the play back of the acoustic signals is preferably performed in a manner to deliver sound substantially separately to each ear of the user. For example, play back may be via headphones, a headset, binaural hearing aids, or otherwise. Such embodiments enable a unique hearing map to be obtained in respect of each ear of the user.

According to a fourth aspect the present invention provides a method of pre-fitting a sound processing device for an individual, the method executed by a computing device and comprising:

obtaining a hearing map representing the user's hearing;

establishing a virtual signal processing path in the computing device which reflects a signal processing function of the sound processing device;

updating parameters of the virtual signal processing path based on said hearing map; and passing an audio signal through the virtual signal processing path and playing back the processed audio signal to the user.

According to a fifth aspect the present invention provides a computing device for pre-fitting a sound processing device for an individual, the device comprising:

a processor configured to obtain a hearing map representing the user's hearing, and for establishing a virtual signal processing path in the computing device which reflects a signal processing function of the sound processing device, the processor further configured to update parameters of the virtual signal processing path based on said hearing map, and to pass an audio signal through the virtual signal processing path and play back the processed audio signal to the user.

According to a sixth aspect the present invention provides a computer program product comprising a computer-readable storage medium storing computer program code means to make a computer execute a procedure for pre-fitting a sound processing device for an individual, the computer program product comprising:

computer program code means for obtaining a hearing map representing the user's hearing;

computer program code means for establishing a virtual signal processing path in the computing device which reflects a signal processing function of the sound processing device;

computer program code means for updating parameters of the virtual signal processing path based on said hearing map; and computer program code means for passing an audio signal through the virtual signal processing path and playing back the processed audio signal to the user.

In embodiments of the fourth to sixth aspects of the invention, the user may be associated with the sound processing device by being interested in purchasing or obtaining the device. In this case the fourth to sixth aspects of the invention are advantageous in providing the user with the opportunity to have the virtual signal processing path customised to their individual hearing map, and in providing the user with the opportunity to experience the customised hearing of sounds, prior to the user actually purchasing or obtaining the device. Additionally or alternatively, the user may already own or possess the sound processing device and may wish to re-fit the device and obtain an advance indication of how the fitting updates will influence the device operation.

In embodiments of the fourth to sixth aspects of the invention, the hearing map may be obtained in accordance with an embodiment of the first to third aspects of the invention. Alternatively the hearing map may be stored by the software from previous fitting sessions and/or obtained from an alternative source such as an audiologist.

In embodiments of the fourth to sixth aspects of the invention, the play back of the acoustic signals is preferably performed in a manner to deliver sound substantially separately to each ear of the user. For example, play back may be via headphones, a headset, binaural hearing aids, or otherwise. Such embodiments enable optimisation of the virtual sound processing device to each ear of the user individually.

In embodiments of the first to sixth aspects of the invention where the acoustic signal is played back by a headset, headphones, or a hearing aid, the played back signal and any obtained user input is preferably specific to one of the user's ears, so that fitting can be customised to each ear individually as appropriate.

In preferred embodiments of the fourth to sixth aspects of the invention, the fitting software executes all play back and obtains all user responses before determining an appropriate set of parameter updates. Such embodiments recognise that such single-update fitting is preferable to piecemeal fitting where the device is updated after each item of user input is obtained, as the latter can lead to overfitting of the device or circular changes where one update reverses a previous update and/or inappropriate side effects in device performance.

The fourth to sixth aspects of the present invention are particularly beneficial in the case of open fit hearing aids, which do not require an earmold to be physically fitted to occlude the individual's ear canal. Open fit hearing aids instead require only fitting of the signal processing parameters, which when provided by the present invention obviates any requirement for the user to see an audiologist, either at the time of obtaining the device or when seeking subsequent fitting updates. The present invention is of course also beneficial to occluding hearing aids and other sound processing devices which are capable of accepting parameter updates.

Embodiments of the first to sixth aspects of the invention may be executed by a personal computer of the user which is connected to the internet via a wired or wireless internet connection. The mapping and/or pre-fitting software is preferably pre-downloaded from an online audiology website and the data input by the user are stored in a de-identified form on a secure database on or associated with the online audiology website.

In embodiments of the fourth to sixth aspects of the invention, speech, music and/or other commonly encountered audio signals are passed through the virtual signal processing path so that the consumer can evaluate the potential benefits obtainable from the customised device under consideration, prior to purchasing or re-fitting the actual device. In preferred embodiments, the user is able to reiterate or fine-tune the customisation and explore alternative types of sound processing devices before purchase.

In embodiments of the fourth to sixth aspects of the invention, once the user is satisfied with the performance of the virtual signal processing path and elects to obtain or purchase the sound processing device reflected by the virtual signal processing path, the updated parameters are preferably pre-loaded into the sound processing device to configure an initial customisation of the sound processing device. The pre-loading may be effected by a sales entity to which the software communicates the user's purchase decision. The sales entity may ship the customised device to the user without the user ever attending premises of the sales entity or any audiologist. Alternatively, the device may be delivered to the user without customisation, for the user to then download the customisation from the computing device executing the pre-fitting software. Once the user has the customised device, they may subsequently validate that the customisations cause the device to perform as required and/or use any of the first to sixth aspects of the invention to conduct further fine tuning iterations if desired. The first to sixth aspects may further be applied to refine or tune the customised device as the user's hearing, needs, and/or preferences change over time. Device supply to the user may be via an intermediary such as an audiology clinic, hearing aid chain, government organisation, or other retail outlet.

In embodiments of the first to sixth aspects of the invention, the computing device may comprise a desktop or laptop personal computer of the user, with an Internet connection, keyboard and headset. Alternatively, in embodiments of the first to sixth aspects of the invention, the computing device may comprise a mobile phone (cell phone) handset with an Internet connection, headphones, and a user interface such as a keypad, touch-screen, keyboard or the like.

The computing device may itself be the sound processing device requiring customisation to the user's hearing, in addition to being the computing device that executes the mapping and/or pre-fitting software and method. For example where the computing device is a mobile phone, audio signal processing by the phone may be customised in accordance with any of the first to sixth aspects of the invention. Such audio processing may for example be that which occurs during telephone use, and/or may be that which occurs in any other audio mode of the device, such as recorded music playback or radio play. Similarly in embodiments where the computing device is a laptop or desktop computer, any or all audio functions of the computer may be customised in accordance with any of the first to sixth aspects of the invention.

In embodiments of the first to sixth aspects of the invention the sound processing device may comprise an open fit hearing aid, an occluding hearing aid, a headset, headphones, a mobile phone handset, an assistive listening device (ALD), or any other product that processes and enhances the hearing of sound. The hearing enhancement sought may be an improvement in speech intelligibility, sound quality, comfort and naturalness of the sound in quiet and/or noisy environments or the appreciation of music. The user may have normal hearing, near-normal hearing or impaired hearing.

In preferred embodiments of the first to sixth aspects of the invention, the user input and/or the automatically derived hearing map and/or the updated fitting is communicated to and stored in a central database, so as to acquire a record of such data over time for the user and for other users. Such embodiments of the present invention recognise that under previous fitting approaches each device must be individually customised and there is no convenient way to store customisation data. In contrast these embodiments of the present invention enable the user input and/or hearing map and/or updated fitting to be stored by the database and later used to be downloaded to multiple devices of different types of the user. In such embodiments the database provides a long-term, easily accessible store for the data so that the user input capture process and hearing map derivation does not have to be repeated every time the purchaser wants to buy a new device.

Moreover, such a database will gather a collection of comprehensive hearing data from a large number of users, and evaluation data for a range of different device types, for people with different needs and preferences. These data may form a valuable resource for hearing science and/or accelerate technology development.

The present invention thus provides a device fitting approach which enables users to conveniently adjust devices themselves if they wish to do so, at a time of their own choosing and in any place where there is a suitably configured computing device. Thus this approach offers substantially more convenience and immediacy than is possible under former approaches in which audiologist visits are required. Embodiments of the invention further enable the user to verify the benefits actually provided once the new customisation is loaded into the device.

According to a seventh aspect the present invention provides a method for customising a sound processing device for an individual consumer. The method comprises: capturing and storing data that quantifies certain characteristics of the consumer's hearing; using stored data to configure an initial customisation of the sound processing device; optionally simulating the sound processing effect of the customised sound processing device; optionally evaluating the potential benefit of the customised device using the simulation; optionally fine-tuning the customisation of the device using the simulation; downloading a customisation to the device; evaluating the benefit of the customised device under controlled conditions; and fine-tuning the customisation of the device under controlled conditions.

According to an eighth aspect the present invention provides a system comprised of an internet portal, at least one sound processing device, additional hardware components for the customisation of the device, and a customisation for the sound processing device. The system comprises: an internet portal with a website, database and downloadable applications software; a personal computer or mobile phone handset with means for the generation of acoustic signals, visual display and buttons or keyboard for the control of the customisation process, signal processor for the simulation of customisable devices, and connection to the internet for the storage and access to data; at least one acoustic output device for the measurement of certain characteristics of the consumer's hearing. Said output device may be headphones or loudspeakers or may be built into the sound processing device; at least one microphone for the measurement of sound pressure levels at the input and/or output of the sound processing device. Said microphone may be built into the sound processing device; a programming interface device or means to connect the sound processing device to the computer so that the sound processing device may be controlled by the computer and customisations may be downloaded from the computer to the sound processing device and optionally uploaded from the sound processing device to the computer; at least one sound processing device. Said device may be a hearing aid, ALD, headset, mobile phone handset or other audio consumer device.

According to a ninth aspect the present invention provides a computer program comprising computer program code means to make a computer execute the steps required for the customisation of a sound processing device. The computer program comprises: a hearing test software module providing computer program means for capturing and storing data that quantifies certain characteristics of the consumer's hearing; a first-fit software module providing computer program means for using stored data to configure an initial customisation of the sound processing device; a simulation software module providing computer program means for optionally simulating the sound processing effect of the customised sound processing device; an evaluation software module providing computer program means for optionally evaluating the potential benefit of the customised device using the simulation; a fine-tuning software module providing computer program means for optionally fine-tuning the customisation of the device using the simulation; a device control software module providing computer program means for downloading a customisation to the device and controlling the device; a real-time validation software module providing computer program means for evaluating the benefit of the customised device under controlled conditions; and a real-time fine-tuning software module providing computer program means for fine-tuning the customisation of the device under controlled conditions.

BRIEF DESCRIPTION OF THE DRAWINGS

An example of the invention will now be described with reference to the accompanying drawings, in which:

FIG. 5 illustrates a display presented to the user by the software of one embodiment of the first to third aspects of the invention, to facilitate mapping of the user's hearing;

FIG. 6 illustrates a hearing map as derived by the software of the embodiment of FIG. 5;

DESCRIPTION OF THE PREFERRED EMBODIMENTS

Figure 1:
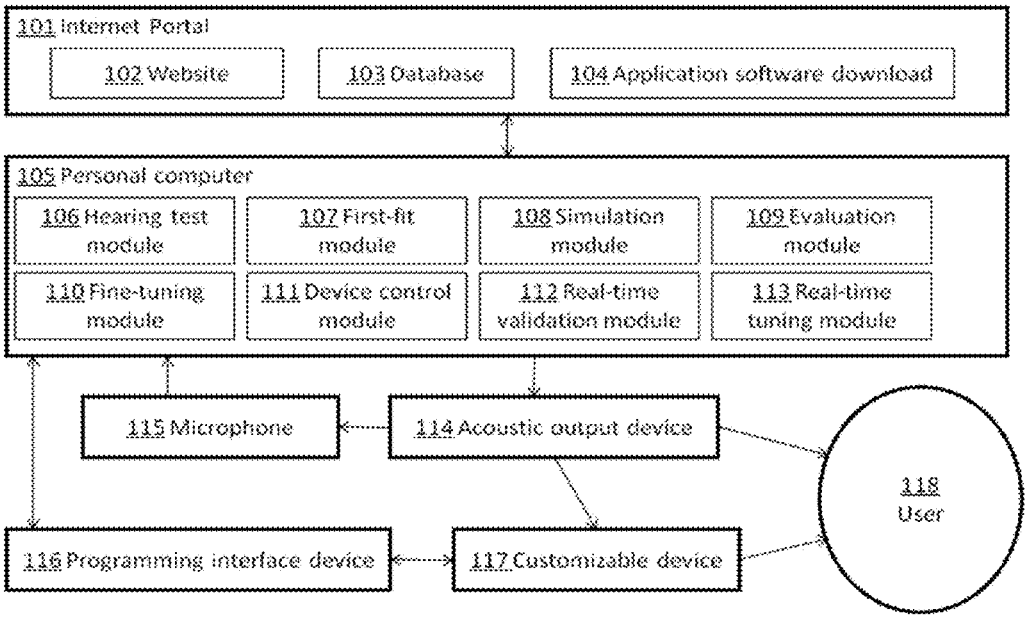
FIG. 1 is a block diagram illustrating one embodiment of an online audiology system for automatically mapping a user's hearing and for pre-fitting a sound processing device in accordance with the present invention.

FIG. 1 is a block diagram illustrating one embodiment of an online audiology system for automatically mapping a user's hearing and for pre-fitting a sound processing device in accordance with the present invention. The internet portal 101 comprises a website 102, a database 103, and downloadable applications software 104.

The function of the website 102 is to attract consumers, explain the potential advantages of using the online audiology system for the enhancement of hearing for individual consumers, explain the contribution of online audiology to the advancement of hearing science and technology, and to provide access to the database 103 and downloadable software 104.

The database 103 stores technical information about devices, the results of hearing tests for individual consumers, and the results of simulated and real-time evaluations of consumers using specific devices. The data for individual consumers is de-identified in the database 103 to ensure the security and privacy of the individual consumer. Each consumer 118 is issued with an encrypted key that will allow access to his or her individual data.

The application software download 104 comprises the personal computer (PC) software that will run on the consumer's personal computer 105 after being downloaded from the Internet portal 101. The applications software includes all of the software modules 106 to 113.

Once the applications software 104 is downloaded and installed, the PC 105 generates sounds via the acoustic output device 114 under control of the software modules 106 to 113. The acoustic output device 114 in this embodiment is a pair of headphones, while in alternative embodiments the acoustic output device 114 may comprise speakers or other audio consumer device capable of being driven by a digital or analogue signal from the PC.

In the embodiment of FIG. 1 the headphones 114 are calibrated so that the sound pressure level of the output signal delivered to the customisable sound processing device 117 can be calculated by the PC from the acoustic waveform.

The embodiment of FIG. 1 further comprises a microphone 115, whereby the output sound from the acoustic output device 114 is picked up by the microphone 115 and relayed back to the PC 105 so that the actual sound pressure level delivered to the device 117 and to the user 118 can be monitored and controlled. The microphone 115 comprises an omnidirectional microphone close to the microphone input of the customisable device 117, and a probe-tube microphone close to the speaker output of the customisable device 117. While the embodiment of FIG. 1 includes a calibrated acoustic output device 114, it is to be noted that the provision of a calibrated microphone 115 enables alternative embodiments to use an uncalibrated acoustic output device 114.

The PC 105 controls the customisable device 117 via the programming interface device 116. In this embodiment, the programming interface device 116 is capable of passing data in both directions so that customisations can be uploaded and downloaded between the PC 105 and the customisable sound processing device 117. It is to be noted that in alternative embodiments, the interface 116 may be used to cause the device 117 to function as the acoustic output device 114 and as the microphone 115, whereby such embodiments may omit a separate output 114 and microphone 115. During hearing tests and simulated or real-time device evaluations, the consumer 118 responds to the sound stimuli presented by entering responses using the keyboard, mouse or other user interface components of the PC 105.

Figure 2:
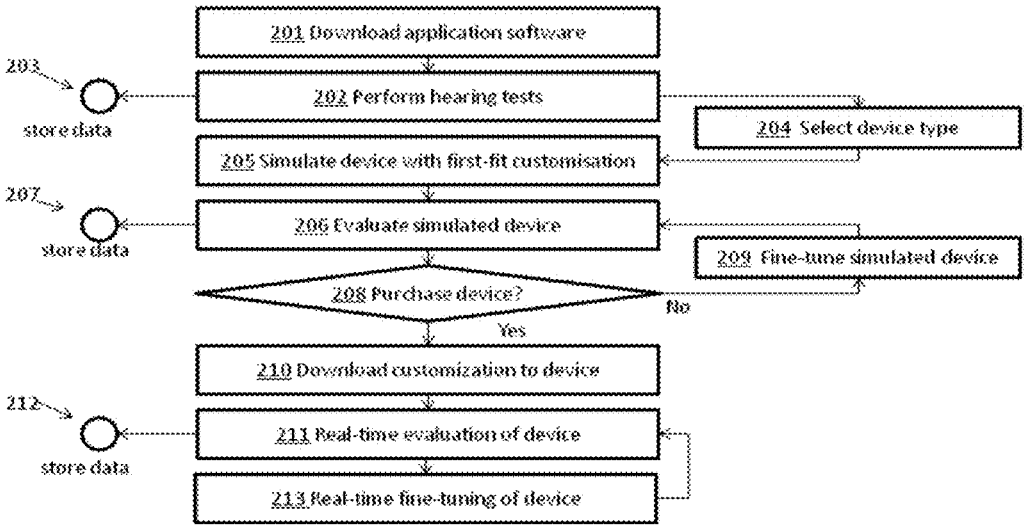
FIG. 2 is a flowchart illustrating the method of using the online audiology system of FIG. 1 to purchase, customise, and validate a sound processing device.

FIG. 2 is a flowchart illustrating the method of using the online audiology system of FIG. 1 to purchase, customise, evaluate and validate a sound processing device. The first step 201 occurs on the first occasion a consumer uses the system. The user downloads the application software 104 from the portal 101.

In step 202, the hearing test software module 106 is used to perform one or more hearing tests, and the results are stored in the database 103 in step 203. Module 106 is an embodiment of the first to third aspects of the invention. The hearing tests may include listening and responding to sounds presented through the acoustic output device 114 (see FIG. 5), data entry of hearing thresholds from a previously measured audiogram, responding to a questionnaire (see FIG. 7), and/or performing a speech intelligibility test in quiet or in background noise.

Once step 203 has been performed, there will be a permanent record of the consumer's hearing data in the database 103, and the consumer can resume working at step 204, selection of a device type at any time. Once a device has been selected, the first-fit software module 107 is used to configure an initial customisation for the device and the simulation software module 108 is configured so as to simulate the customised device in step 205. Modules 107 and 108 comprise an embodiment of the fourth to sixth aspects of the invention. Simulation of the customised device by module 108 involves establishing a virtual signal processing path which mimics operation of the selected device, using the customised control parameters established by module 107.

In step 206, the simulated device is evaluated using the evaluation module 109, which causes the user to listen and respond to sounds that have been processed by the simulated device. Typically, this will include a questionnaire and/or performing a speech intelligibility test in quiet or in background noise. At the end of the evaluation, the results and the details describing the customisation will be stored in the database 103 (step 207). If the user is satisfied with the result, they may decide to purchase a device, or otherwise they may experiment using the fine tuning module 110 in step 209.

Steps 206 to 209 may be repeated iteratively until the consumer is happy with the sound of the simulated device, or gives up. After giving up, the consumer may return to the portal and perform a new hearing test (step 202), choose another device (step 204), or continue fine tuning the current device (step 209).

After purchasing a device, the consumer may return to the portal 101 and download from database 103 the customisation that has already been fine-tuned with the simulation using the device control software module 111 (step 210). Alternatively the user may evaluate the function of the device using the real-time validation software module 112 (step 211), store the data (step 212) and/or fine-tune the device using the real-time tuning software module (step 213).

Modules 107, 108, 110 and 113 utilise a number of methods for customisation of devices. Importantly, these modules provide some customisation methods which do not depend on knowledge of or measurement of the consumer's audiogram. Rather, the hearing map derived by module 106 is sufficient for some customisation methods to be carried out. These modules do also have the ability to customise devices when the audiogram is known, using conventional audiogram-based methods. If hearing thresholds are available for modules 107, 108, 110 and 113, these thresholds may be used as a reference point for display of the device output levels or as additional data in the customisation process.

Figure 3:
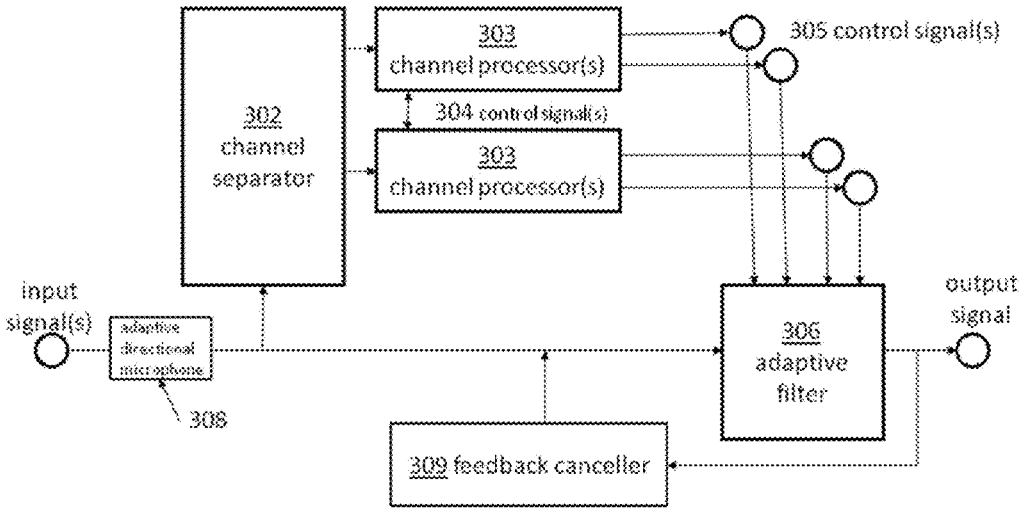
FIG. 3 is a block diagram of the system architecture of a sound processing device which may be customised in accordance with the present invention.

FIG. 3 is a block diagram of the system architecture of a sound processing device which may be customised in accordance with the present invention. In this sound processing architecture, there is provided an adaptive directional microphone (ADM) 308, a channel separator 302 (such as a FFT block), channel processors 303 for each channel, inter-channel control signals 304, filter control signals 305 to control an in-line adaptive filter 306, and a feedback canceller (FBC) 309. Typically most if not all of elements 302-208 will operate under control of respective parameters. For example operation of the ADM 308 may rely upon parameters defining among other values a signal energy threshold below which operation reverts to omnidirectional behaviour. Similarly, operation of channel separator 302 may be influenced by parameters defining band width and spectral location of each channel. Channel processors 303 may for example execute the ADRO technique set out in U.S. Pat. No. 6,731,767 or 7,366,315, the contents of which are incorporated herein by reference. Channel processors 303 may in such embodiments operate under control of parameters which indicate for each channel the user's hearing threshold, comfort level, and maximum comfort level. In accordance with the present invention, parameters controlling operation of system elements 302-308 may be updated by the interface 116 in order to customise the device. The present invention is of course applicable to sound processing devices differing from that shown in FIG. 3.

Figure 4:
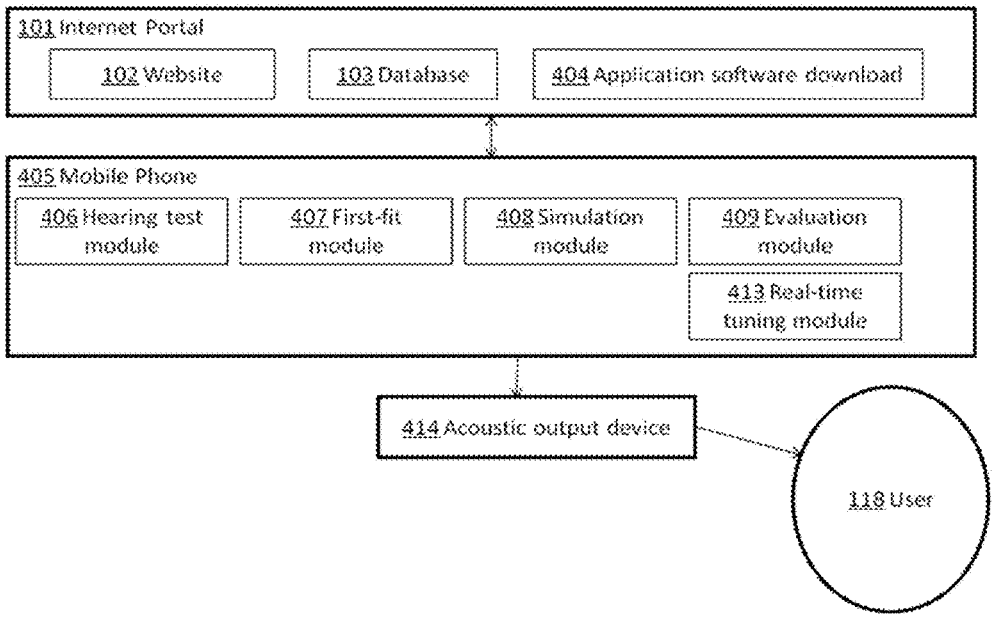
FIG. 4 is a block diagram illustrating another embodiment of an online audiology system for automatically mapping a mobile phone user's hearing, and for pre-fitting and re-fitting a mobile phone, in accordance with the present invention.

FIG. 4 is a block diagram illustrating an online audiology system for automatically mapping a mobile phone user's hearing, and for pre-fitting and re-fitting a mobile phone, in accordance with another embodiment of the present invention. Internet portal 101, website 102 and database 103 of the first embodiment shown in FIG. 1 are also used for this embodiment. The Internet portal 101 holds downloadable application software 404 suitable for being downloaded to, installed, and executed upon the mobile phone 405 of the user 118.

In the embodiment of FIG. 4, the hearing test module 406, first fit module 407 simulation module 408 evaluation module 409 and tuning module 413 are executed by the processor of a mobile phone handset 405. As the phone 405 itself is the sound processing device, there is no requirement for a separate programming interface. This embodiment enables the user to use their phone to execute module 406 to derive the user's hearing map. The acoustic signals are presented to the user via independent binaural speakers, such as by use of a stereo headset or stereo earbuds. The output levels of the headset or earbuds are preferably known a priori by the module 406 so that improved knowledge of the actual sound intensity levels at the user's ear can be used by module 406 when deriving the hearing map. The phone may then execute first fit module 407 in order for module 408 to establish a simulated customisation of the phone's audio processing path. Upon evaluation 409 and fine tuning 413, the simulated audio processing path may be put to use for all actual audio processing by the phone, thereby customising the phone's audio processing so as to accommodate the user's hearing map. The acoustic output 414 of the phone may be the headphones provided by the phone manufacturer. In this embodiment the flowchart of FIG. 2 may be applied by omitting steps 205 to 209.

In a further embodiment of the invention (not shown), the personal computer 105 may be the customisable device, as well as being the device that runs the mapping and fitting software. In this case, an audio processing path of the PC can be customised so that all sounds produced by the PC are optimised for the user. Once again, in this embodiment the flowchart of FIG. 2 may be applied by omitting steps 205 to 209.

FIG. 5 illustrates a display presented to the user for the purpose of mapping the user's hearing, to further illustrate the operation of modules 106 and 406 and the nature of step 202. Nine pre-recorded sounds are made available for acoustic playback in order to investigate the user's ability to hear different sound categories. The GUI presents nine stimulus icons/activation buttons indicated at 502 which the user can select by mouse-click, in any order, to cause playback of the associated pre-recorded sound. The pre-recorded sounds, and their associated tone and temporal nature, are: a slamming door (dull tone, sudden); a ringing phone (mid tones, sudden); clanking pots and pans (bright tones, sudden); traffic noise (dull tone, sustained); horn blasts (mid tones, sustained); electric drill (bright tones, sustained); rolling thunder (dull tones, soft onset), the sound of a cascade (mid tones, soft onset); and bird chatter (bright tones, soft onset). Each sound has been pre-filtered to ensure that it predominantly contains frequency components in one selected range; low frequencies (dull tones), mid frequencies (mid-tones) of high frequencies (bright tones), in the audible range. The user clicks each icon to cause the software to acoustically play back the associated sound, and the user then indicates by mouse-clicking one of buttons 504 whether the played back sound is too loud, of acceptable volume, or too soft. One or more of the nine sounds 502 may be played back more than once, with the software adjusting the loudness at each iteration as appropriate in response to the user selection at 504, until the user indicates that the loudness of that sound is comfortable. Such user input may be used in deriving the hearing map or audiogram of the user. Notably, the separate investigation of the user's perception of sudden sounds and sustained sounds, respectively, allows the perceived loudness assessment to accommodate the differing perceptions of such temporally distinct sounds by typical human hearing.

FIG. 6 illustrates a hearing map as may be derived by the software of the embodiment of FIG. 5. In this embodiment the hearing map is an audiogram. The user may for example directly enter their audiogram if they know the relevant values. This can be entered graphically by the user clicking on the chart of FIG. 6 to enter their hearing loss in each frequency band, as indicated at 602. Alternatively the audiogram can be entered numerically by the user typing in their hearing loss in dB in each frequency band, as indicated at 604. In the chart of FIG. 6 the y-axis represents the user's hearing threshold in dB, with better hearing plotted towards the top of the chart and poorer hearing plotted at the bottom. The audiogram shown indicates the user has a fairly typical hearing loss with greater hearing loss in the higher frequencies.

Figures 7, 8:
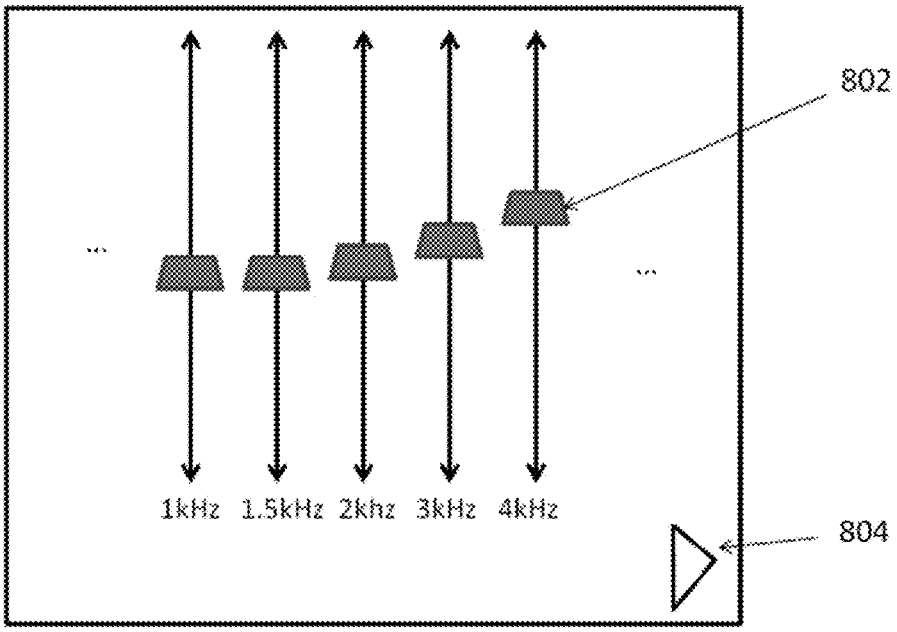
FIG. 7 illustrates a questionnaire presented to the user by the software of the embodiment of FIG. 5.
FIG. 8 illustrates a graphical user interface for obtaining user input to derive an equal loudness contour for a hearing map.

In an alternative embodiment of FIG. 8, the hearing map is in the form of an equal loudness contour. The equal loudness contour of FIG. 8 is obtained by playing back a sound to the user in each of a plurality of frequency bands, and asking the user to adjust the loudness level in each band using the slider 802 for that band, and again mouse-clicking on the play button 804, until the played back sounds in all bands are perceived by the user as being at the same loudness. The loudness level is adjusted by the user controlling a graphical user interface, by moving the on-screen virtual sliders 802. After the user has balanced the loudness in each band, the positions of the sliders provide a visual indication of the equal loudness contour making up a part of the hearing map. The equal loudness contour of FIG. 8 might be that produced by the user having the audiogram of FIG. 6.

FIG. 7 illustrates a questionnaire presented to the user by the software of the embodiment of FIG. 5. Each question is to be answered in respect of both the left ear and the right ear, by the user clicking on one reply per question per ear. Further questions not shown, and presented in a corresponding format as for the questions shown in FIG. 7, include loudness-related questions such as:

the loudness of your own breathing sounds;
the loudness of speech on TV and radio sounds;
The loudness of speech in background noise is; and
the loudness of music is;

for which the available answers are:

Too loud;
Loud but ok;
Comfortable;
Soft but ok; and
Too soft.

In this embodiment the questionnaire further includes quality-related questions such as:

the quality of your own voice sounds;
the quality of speech on TV and radio sounds;
the quality of speech in the presence of background noise sounds;

when talking to one other person in a quiet place, their speech sounds;

the quality of music sounds;

for which the available answers are:

Distorted, sharp with static;

High pitched or tinny;

Clear;

Hollow or echoing; and

Muffled or dull.

In this embodiment the questionnaire further includes changing program-related questions such as:

do you have any problems changing programs?;

for which the available answers are:

No problems;

Yes, I find it difficult; and

Not applicable.

In this embodiment the questionnaire further includes beep-related questions such as:

can you hear the beep when changing programs?;

for which the available answers are:

Yes, I can hear a different number of beeps for each program;

No, it is difficult to hear the beeps; and

Not applicable.

In this embodiment the questionnaire further includes music-related questions such as:

my taste in music includes.

for which the available answers are:

Classical;

Jazz and blues;

Rock; and

Pop.

By providing detailed but categorised queries, the present embodiment enables subjective feedback of a plurality of users to be meaningfully compared when gathered in the database 103. Such a suitably designed questionnaire further improves the ability of this system to tune the sound processing device to reduce the number or severity of adverse responses to the questionnaire for an individual user.

The advantages of the described embodiments of the present invention include rapid and convenient access to high-quality audiological services and hearing aids for consumers in remote locations or in countries where audiology services are rudimentary or non-existent, and convenient access to and use of data collected in previous sessions and stored on the portal to increase the efficiency and reduce the cost of audiology service and product provision. These embodiments also provide an effective method of individual customisation of non-hearing aid devices requiring complex adjustments, without increasing the size and complexity of the devices themselves. A further advantage is in allowing a potential consumer to assess the benefits obtainable from a device prior to purchase of the device. The described embodiments further allow a consumer to verify the benefits of the device after purchase, and refine the customisation to optimise those benefits for themselves. These embodiments thus provide the consumer with much greater control of meeting their own sound processing needs. A further benefit from the online audiology system is the collection of comprehensive hearing data from many consumers and evaluation data for a range of different device types for people with different needs and preferences. These data will form a valuable resource for hearing science and may accelerate technology development.

Some portions of this detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

As such, it will be understood that such acts and operations, which are at times referred to as being computer-executed, include the manipulation by the processing unit of the computer of electrical signals representing data in a structured form. This manipulation transforms the data or maintains it at locations in the memory system of the computer, which reconfigures or otherwise alters the operation of the computer in a manner well understood by those skilled in the art. The data structures where data is maintained are physical locations of the memory that have particular properties defined by the format of the data. However, while the invention is described in the foregoing context, it is not meant to be limiting as those of skill in the art will appreciate that various of the acts and operations described may also be implemented in hardware.

It should be borne in mind, however, that all of these and similar terms are to be associated with the appropriate physical quantities and are merely convenient labels applied to these quantities. Unless specifically stated otherwise as apparent from the description, it is appreciated that throughout the description, discussions utilising terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialised apparatus to perform the required method steps. The required structure for a variety of these systems will appear from the description. In addition, the present invention is not described with reference to any particular programming language. It will be appreciated that a variety of programming languages may be used to implement the teachings of the invention as described herein.

References herein to "sound processing" or "sound processing device" are to be understood to include processing of digital electrical signals representing or conveying a sound or sounds. The signals may be processed and played back from a memory storage (as in the case of recorded music players), or may be live signals from a microphone (as in the case of a hearing aid) or telephone network (as in the case of telephones).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of fitting a sound processing device for a user, the method executed by a computing device and comprising:

playing back acoustic signals to the user, the acoustic signals comprising at least one synthesized or recorded spoken word;

obtaining user input related to the user's perceptions of the acoustic signals, by providing a user interface through which the user may enter the word or words which the user heard;

deriving from said user input a hearing map representing the user's hearing, by determining an accuracy of the user input relative to the word or words actually played back and estimating a percentage of information transmitted to the user in order to estimate hearing map parameters within specific frequency bands; and updating a fitting of the sound processing device based on said hearing map.

2. The method of claim 1, further comprising monitoring the sound pressure level of the acoustic signals and controlling the level of the acoustic signals in response to the monitored sound pressure level.

3. The method of claim 1 further comprising, prior to obtaining the user input, the computing device presenting a hearing questionnaire to the user in order to elicit user input in the form of the user's answers to the questionnaire.

4. The method of claim 1 wherein the user input further gives an indication of at least one of types of information selected from the group consisting of: the user's hearing thresholds, the user's comfort levels, the user's discomfort thresholds, and the user's sound quality ratings for music and other sounds.

5. The method of claim 1 further comprising recording the user input on at least one device selected from the group consisting of: the computing device, and a central database.

6. The method of claim 1 further comprising the preliminary step of downloading via the internet a software application for installation upon the computing device and for executing the method.

7. A device for fitting a sound processing device for user, the device comprising:

an audio output;

a user interface to accept user input;

a processor configured to:

play back acoustic signals to the user via the audio output, the acoustic signals comprising at least one synthesized or recorded spoken word, and to obtain via the user interface user input related to the user's perceptions of the acoustic signals, wherein the user the word or words which the user heard;

derive from said user input a hearing map representing the user's hearing, by determining an accuracy of the user input relative to the word or words actually played back and estimating a percentage of information transmitted to the user in order to estimate hearing map parameters within specific frequency bands; and update a fitting of the sound processing device based on said hearing map.

8. The device of claim 7 wherein the sound processing device is selected from the group consisting of: the computing device, a desktop computer, a laptop computer, a mobile phone, a personal digital audio player, an open fit hearing aid, an occluding hearing aid, a headset, headphones, and an assistive listening device (ALD).

9. The device of 7 wherein the processor is further configured to monitor a sound pressure level of the acoustic signals and control the level of the acoustic signals in response to the monitored sound pressure level.

10. The device of claim 7 wherein the processor is further configured to present a hearing questionnaire to the user in order to elicit further user input in the form of the user's answers to the questionnaire.

11. The device of claim 7 wherein the user input further gives an indication of at least one of types of information selected from the group consisting of: the user's hearing thresholds, the user's comfort levels, the user's discomfort thresholds, and the user's sound quality ratings for music and other sounds.

* * * * *